US008864548B2

(12) United States Patent
Nguyen et al.

(10) Patent No.: US 8,864,548 B2
(45) Date of Patent: Oct. 21, 2014

(54) TOY WITH VISCOUS SKELETON

(75) Inventors: Viet Nguyen, Lakewood, CA (US); Michael O'Hare, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 287 days.

(21) Appl. No.: 13/421,694

(22) Filed: Mar. 15, 2012

(65) Prior Publication Data

US 2012/0238183 A1 Sep. 20, 2012

Related U.S. Application Data

(60) Provisional application No. 61/454,351, filed on Mar. 18, 2012.

(51) Int. Cl.
*A63H 3/36* (2006.01)
*A63H 3/04* (2006.01)

(52) U.S. Cl.
CPC ... *A63H 3/04* (2013.01); *A63H 3/36* (2013.01)
USPC ..... 446/373

(58) Field of Classification Search
USPC ..... 446/329, 337, 338, 369, 370–373, 375, 446/376, 391; 434/274
See application file for complete search history.

(56) References Cited

U.S. PATENT DOCUMENTS 3,395,484 A * 8/1968 Smith ..... 446/374
4,192,512 A 3/1980 Erickson et al.
4,375,733 A 3/1983 Callais, Jr.
4,518,367 A * 5/1985 Zaruba et al. ..... 446/373
4,738,647 A 4/1988 Renger et al.
5,006,089 A 4/1991 Lee
5,061,187 A * 10/1991 Jerath ..... 434/262
5,171,151 A 12/1992 Barthold
5,207,728 A 5/1993 Fogarty et al.
5,297,980 A 3/1994 Barthold
5,480,341 A 1/1996 Plakos
5,494,472 A * 2/1996 Levy et al. ..... 446/295
5,516,322 A 5/1996 Myers
5,518,436 A 5/1996 Lund et al.
5,603,176 A 2/1997 Eddins et al.
5,619,980 A 4/1997 Lee et al.
5,810,640 A 9/1998 Clarke et al.
5,846,118 A 12/1998 Wu
5,934,969 A 8/1999 Rehkemper et al.
5,941,712 A * 8/1999 Smith ..... 434/365
5,954,561 A 9/1999 Cannone
6,174,216 B1 1/2001 Chianese
6,193,578 B1 2/2001 Weber
6,468,088 B1 10/2002 Fujita et al.
6,503,582 B1 1/2003 Nardoza et al.
6,533,637 B1 3/2003 Liao
6,575,807 B2 6/2003 Spector
6,589,096 B1 7/2003 Doane, Jr. et al.
6,746,303 B2 6/2004 Beidokhti (Continued)

*Primary Examiner* — Kurt Fernstrom
(74) *Attorney, Agent, or Firm* — Edell, Shapiro & Finnan LLC

(57) ABSTRACT

A toy figure has a loosely held skeleton with multiple structural elements resembling or simulating bones of the skeleton. The skeleton also includes a fluid or liquid material that resembles a soft tissue coupled to a portion of the structural elements. In addition, a play set includes a receptacle in which a viscous fluid is located so that a portion of the skeleton can be moved to engage the fluid. A child can move a portion of the skeleton away from the receptacle, thereby displaying the fluid on the structural elements.

20 Claims, 4 Drawing Sheets

(56) References Cited

U.S. PATENT DOCUMENTS

| | | | |
|---|---|---|---|
| 6,800,014 | B2 | 10/2004 | Dominici et al. |
| 6,881,119 | B2 | 4/2005 | Panec et al. |
| 6,932,669 | B2 | 8/2005 | Lee et al. |
| 7,338,342 | B2 | 3/2008 | Bellon |
| 7,479,054 | B2 | 1/2009 | Wittenberg et al. |
| 2004/0266315 | A1 | 12/2004 | Ejima et al. |
| 2006/0019574 | A1 | 1/2006 | Solomita |
| 2009/0298381 | A1 | 12/2009 | Fink |

* cited by examiner

TOY WITH VISCOUS SKELETON

CROSS-REFERENCE TO RELATED APPLICATION

This application claims priority to and is based on U.S. Patent Application. No. 61/454,351, filed Mar. 18, 2012, entitled "Toy with Viscous Skeleton," the entire disclosure of which is incorporated by reference herein in its entirety.

FIELD OF THE INVENTION

The invention relates generally to a toy figure having a loosely held skeleton and fluid soft tissue. The toy figure provides a novel structure for encouraging play and incorporates a viscous fluid element for greater flexibility and manipulation of the toy figure.

BACKGROUND OF THE INVENTION

The use of slime, flubber and other viscous fluids has long been an attractive feature for children's toys. The flexibility and strong bonding nature of these fluids have fascinated children and adults alike, and have provided hours of entertainment. The present invention imparts a novel apparatus for play by providing a toy figure having a skeleton loosely tethered together and incorporating a viscous fluid. The viscous fluid is configured to tackily adhere to the skeleton and comply with skeletal movement. The tackily adhered fluid mimics the decaying soft tissue and/or organs of the toy figure to create an interesting play effect.

SUMMARY OF THE INVENTION

In one embodiment a toy figure is provided, wherein the toy figure comprises a skeleton having at least two structural members or bones tethered together by a resilient member, and a viscous fluid configured to tackily adhere to the skeleton.

In an embodiment of the invention, the resilient member tethering the at least two structural members or bones is an elastomer, a fabric, a string, a wire, plastic filament, other tethering means known in the art, derivatives thereof, and combinations thereof.

In another embodiment, the toy figure and/or the viscous fluid may further comprise a visual effect to enhance play. The visual effect may include various elements known in the art, including but not limited to, lights, a photochromic paint or dye, a thermochromic paint or dye, a hologram, a fluorescent paint or dye, derivatives thereof, and combinations thereof.

In yet another embodiment, the toy figure further comprises a sound effect to enhance play. The sound effect may include various elements known in the art. In some embodiments, the sound effect may comprise a speaker, a processor, pre-recorded audio sounds, derivatives thereof, and combinations thereof.

In one embodiment of the present invention, the toy figure further comprises a play surface for use in conjunction with the toy figure and configured to retain the viscous fluid associated with the figure. The play set may comprise a receptacle or basin for retaining the fluid.

In yet another embodiment of the present invention, the viscous fluid may comprise solid or semi-solid components configured to emulate organic elements.

In one embodiment of the invention, a toy figure comprises a skeleton body having a first structural member and a second structural member; a resilient member coupling the structural members to each other; and a viscous fluid adhering to the structural members of the skeleton.

In an alternative embodiment, the toy figure includes a skull coupled to the skeleton body. The skull includes an articulating jaw member and an actuator coupled to the jaw member, the actuator being operable to move the jaw member relative to the skull.

In an alternative embodiment, the structural members resemble bones of the skeleton body.

In another embodiment of the invention, a toy assembly comprises a toy figure including a skeleton body having a first structural member, a second structural member, and a flexible elongate member coupling the structural members together; and a base including a play surface defining a receptacle, the receptacle being configured to receive a portion of the toy figure, the receptacle containing a viscous fluid disposed therein, the viscous fluid being adhered to the toy figure when the portion of the toy figure engages the fluid.

In an alternative embodiment, the elongate member is coupled to the base.

In other embodiments, the toy assembly includes a projectile launcher, a second figure, and/or a stand coupled to the base, the stand configured to support the second figure relative to the base.

In one embodiment, a toy assembly comprises a toy figure including a body portion having a first structural member resembling a bone and a second structural member resembling a bone; and an elongate member coupling the structural members together, the elongate member being flexible; and a play set including a base having a surface defining a receptacle, the receptacle being configured to receive a portion of the toy figure; and a viscous fluid disposed in the receptacle, wherein the viscous fluid tackily adheres to the toy figure when the toy figure is engaged with the viscous fluid.

In an alternative embodiment, the toy figure includes a handle portion coupled to the skull, the handle portion being configured to be grasped by a user. The handle portion is useable to move at least one of the structural members into engagement with the viscous fluid.

In an alternative embodiment, the receptacle is configured to receive at least one of the structural members.

In an alternative embodiment, each of the structural members has a hole defined therein, and the elongate member extends through a hole of each structural member. Also, the elongate member is coupled to the base.

Other objects, features and advantages of the invention will be understood more readily after consideration of the Detailed Description taken in connection with the accompanying drawings.

DETAILED DESCRIPTION

Figure 1:
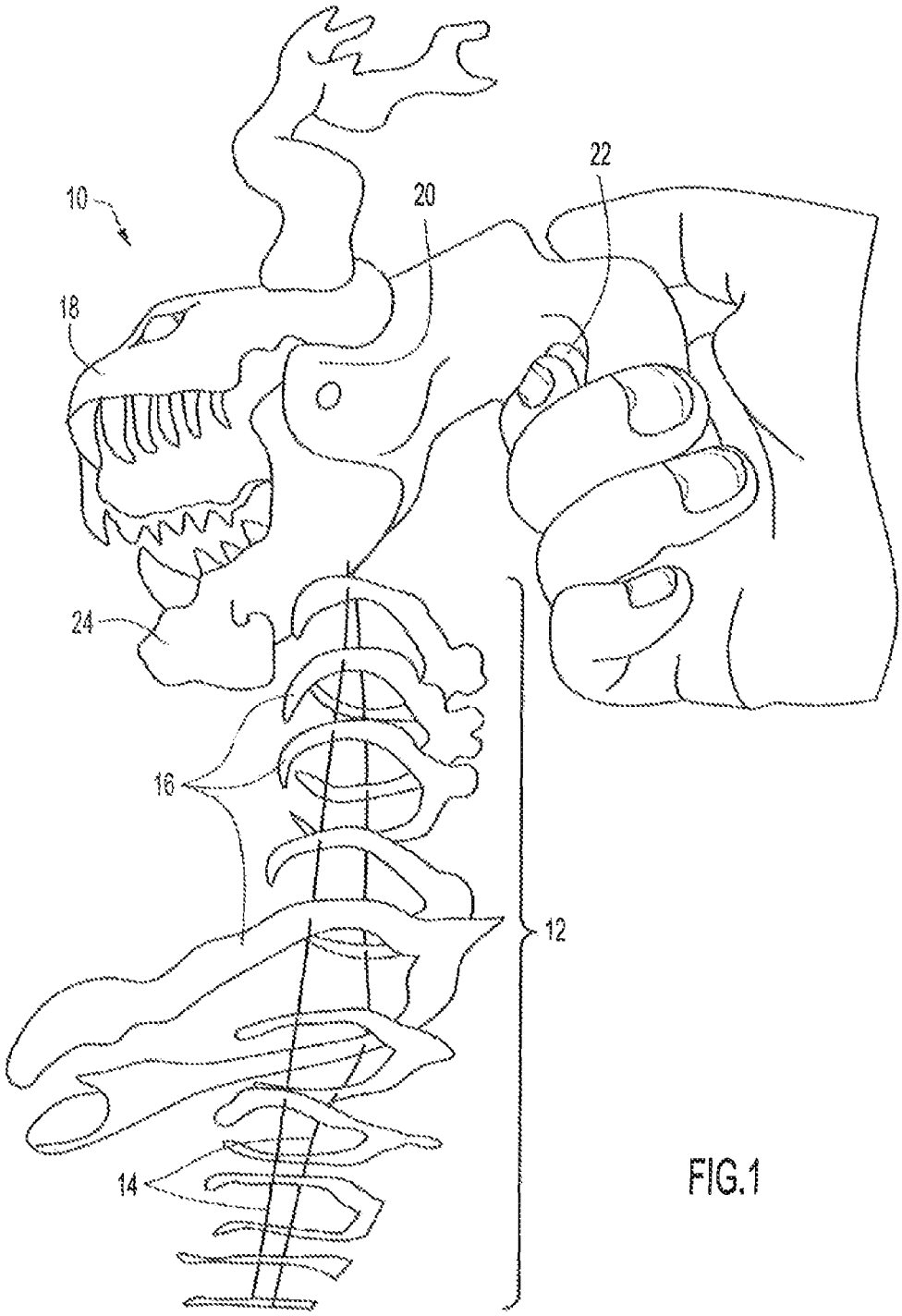
FIG. 1 illustrates a side perspective view of a toy figure in accordance with an embodiment of the present invention.
Figure 2:
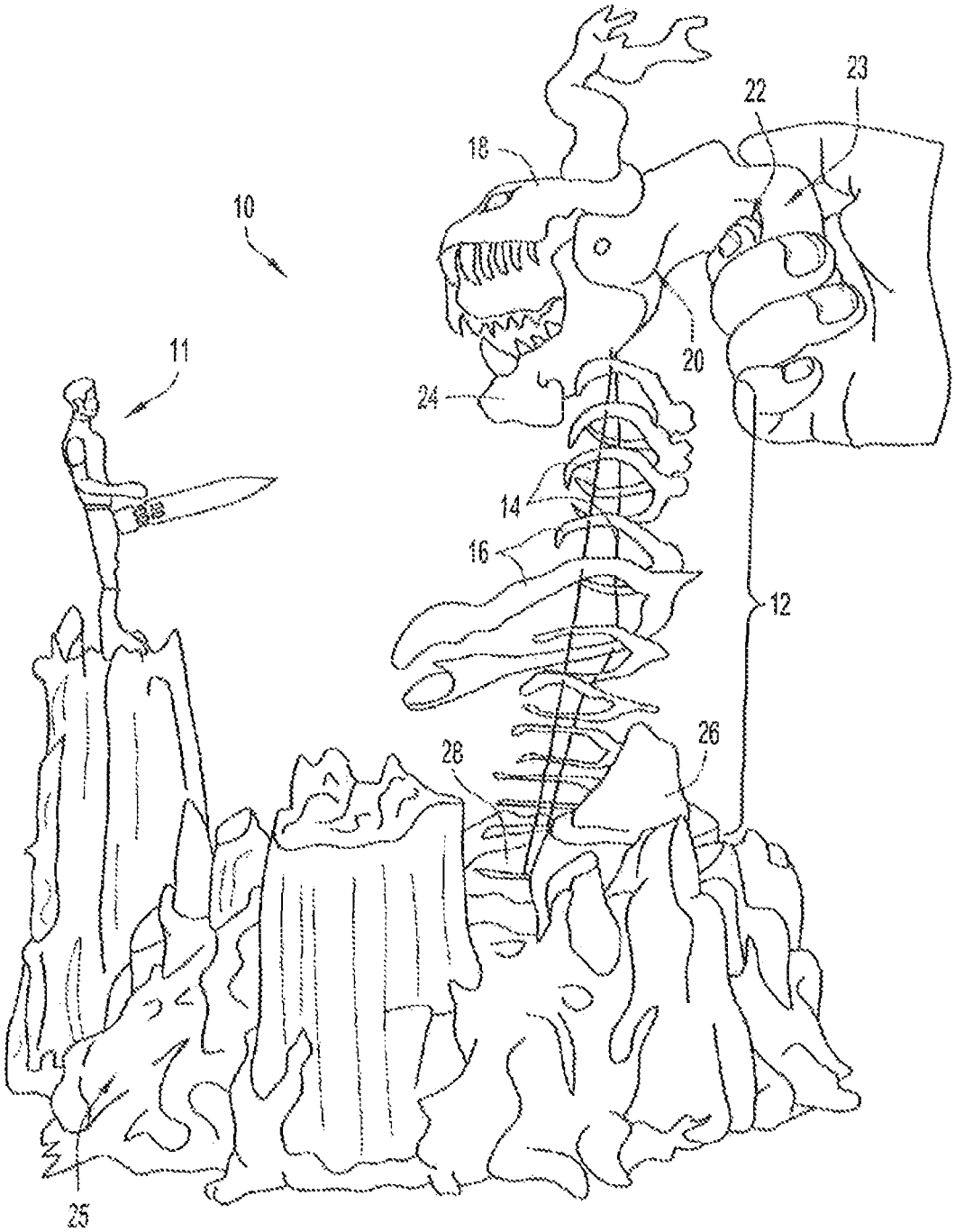
FIG. 2 illustrates a side perspective view of a toy figure and play surface in accordance with an embodiment of the present invention.
Figure 3:
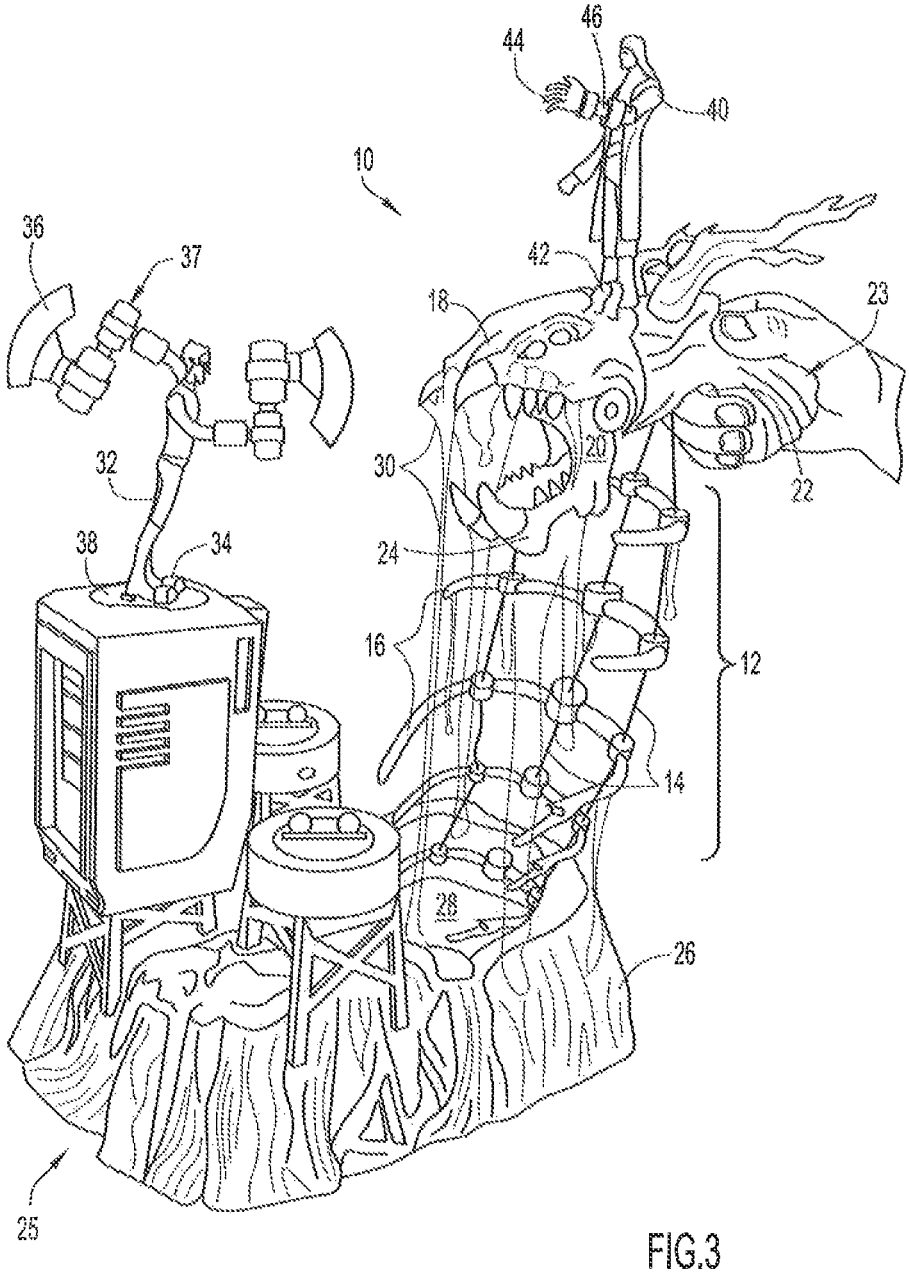
FIG. 3 illustrates a side perspective view of a toy figure and play surface in accordance with another embodiment of the present invention.

Referring to FIGS. 1, 2, and 3, side perspective views of a toy FIG. 10 (and in the case of FIGS. 2 and 3, a play set or surface 26 as well) in accordance with embodiments of the present invention are illustrated. The toy FIG. 10 comprises a skeleton or skeleton body 12 having at least two structural members 16 resembling or simulating bones of a skeleton. The skeleton 12 also includes a resilient member 14 tethering the at least two structural members or bones 16 together. The resilient member 14 is an elongate member with opposite ends, and in one embodiment, is a flexible member.

The structural members or bones 16 are attached to the resilient member 14 at various distances to accomplish the look of a floating skeleton 12. In the embodiments shown in FIGS. 1-3, the floating skeleton 12 is formed by employing knots at various points of the resilient member 14 and passing the resilient member 14 through a hole formed on each structural member or bone 16, thus allowing each bone 16 to rest against one of the knots. The outer circumference of the hole found on the bone 16 is less than the outer circumference of the knot formed in the resilient member 14.

In other embodiments, the resilient member 14 may be attached to the bone 16 by various means known in the art. The pliant nature of the resilient member 14 allows for movement of the FIG. 10 in all three axes, while retaining the overall skeletal shape of the FIG. 10. The toy FIG. 10 further comprises a fluid 30 (see FIG. 3), configured to be tacky yet viscous, to allow the fluid 30 to partially adhere to the FIG. 10. The at least two bones 16 of floating skeleton 12 provide ample surface area for adhering the fluid 30 to the skeleton 12. The pliant nature of the skeleton 12 in combination with the tacky fluid 30 allows the fluid 30 to tackily adhere to the skeleton 12 as the FIG. 10 is manipulated and maneuvered, creating an interesting and entertaining gelatinous play toy figure. In further embodiments, the tackily adhered fluid 30 may include various components configured to emulate organic elements, including soft tissue, organs, tendons, bones, derivatives thereof, and combinations thereof.

As shown in FIGS. 1-3, a skull 18 is attached to the top of the skeleton or skeleton body 12 as an additional play element. The skull 18 comprises a jawbone or jaw member 24 and a handle portion with a trigger or actuator 22 for articulating or moving the jawbone 24. The jawbone 24 is mechanically articulated about the pivot point 20 by engaging the trigger 22. Although a mechanical trigger 22 has been disclosed, the articulated jawbone 24 may be actuated by an alternative mechanism. The handle portion 23 is coupled to the skull 18 and is configured to be grasped by a user. The handle portion 23 is useable to move the skeleton proximate to the base 25 and into engagement with the viscous fluid.

The resilient member 14 may be fabricated from any suitable material, or combinations of materials, such as supple natural or synthetic materials including, but not limited to, cotton, elastomers, polyester, wire, plastic filament, derivatives thereof, and combinations thereof. The bones 16 and skull 18 may be fabricated from any suitable material, or combination of materials, such as plastic, foamed plastic, wood, cardboard, pressed paper, metal, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

The fluid 30 may be composed of any suitable ingredient, or combination of ingredients, including a binder (e.g. polyvinyl alcohol, guar gum), water, oil (e.g. mineral oil, vegetable oil), starch, glycerin, talc, silica, a crosslinking system, variations or derivatives thereof, and combinations thereof. In one embodiment, the fluid 30 comprises water, a binder, and a crosslinking system, wherein the crosslinking system comprises potassium bicarbonate, sodium carbonate, and a borate salt. In various embodiments, the crosslinking system may comprise a phosphoric acid salt, a carbonic acid salt and a boric acid salt. In yet another embodiment, the fluid 30 comprises about 92-97 wt % water, about 0.5-1.5 wt % binder, about 0.1-1.5 wt % sodium phosphate, about 0.01-0.5 wt % sodium carbonate, and about 0.005-0.2 wt % sodium tetraborate. In an exemplary embodiment, the fluid 30 comprises about 95 wt % water, about 1 wt % binder, about 0.40 wt % sodium phosphate, about 0.15 wt % sodium carbonate, and about 0.05 wt % sodium tetraborate. Reference is made to U.S. patent application Ser. No. 12/957,721 to Cordova, and U.S. Pat. No. 6,387,169 to Cordova, U.S. Pat. No. 6,380,300 to Cordova, U.S. Pat. No. 5,990,205 to Cordova, and U.S. Pat. No. 5,972,092 to Cordova, the disclosures of which are incorporated herein in their entirety.

Referring to FIGS. 2 and 3, the toy assembly includes a base 25 with a play surface 26 for use with the FIG. 10 as illustrated. The base 25 is configured to be placed on a support surface. In one embodiment, the play surface 26 comprises a receptacle or basin 28 configured to hold a fluid 30. The basin 28 is configured to allow the FIG. 10 to be at least partially submerged in the basin 28, allowing the FIG. 10 to contact the fluid 30. In one embodiment, the receptacle 28 is configured so that a portion of the FIG. 10 is engageable with the viscous fluid 30 in the receptacle 28. The resilient or elongate member 14 is coupled to the base 25. As shown, another toy FIG. 11 can be used with the base 25 having the play surface 26.

FIG. 3 also illustrates a second FIG. 32 removably attached to the play surface 26 by placing the figure on a stand 34. The second FIG. 32 may further comprise at least one projectile 36 and projectile launching means 37 for launching the projectile 36 at a target. The second FIG. 32 may be manually adjusted using a rotating base 38 for aiming the projectile 36 at a target. FIG. 3 also provides a third FIG. 40 removably attached to the FIG. 10 using a stand 42. The third FIG. 40 may comprise at least one projectile 44 and projectile launcher 46 as an additional play feature.

In further embodiments, the FIG. 10 and/or the fluid 30 may comprise a visual effect to enhance play features of the toy FIG. 10 and provide added entertainment. The visual effect may include various elements known in the art, including but not limited to, lights, a photochromic paint or dye, a thermochromic paint or dye, a hologram, a fluorescent paint or dye, derivatives thereof, and combinations thereof.

In additional embodiments, the FIG. 10 may comprise a sound effect to enhance play features of the toy FIG. 10 and provide added entertainment. The sound effect may include various elements known in the art. Sound effects may comprise a speaker, a processor, a microphone, pre-recorded audio sounds, derivatives thereof, and combinations thereof.

In an embodiment, the FIG. 10 is further tethered to the play surface 26 restricting movement of the FIG. 10 and accompanying fluid 30, and containing the FIG. 10 and fluid 30 about the play surface 26.

In yet another embodiment, the play surface 26 further comprises a projectile launcher for launching a projectile at a target. The projectile launcher may be manually adjustable for aiming the projectile at a target. The target may comprise the FIG. 10.

In yet another embodiment, the play set 26 and/or FIG. 10 further comprise at least one stand for retaining at least a second figure. The second figure may include a projectile launcher and/or target.

Figure 4:
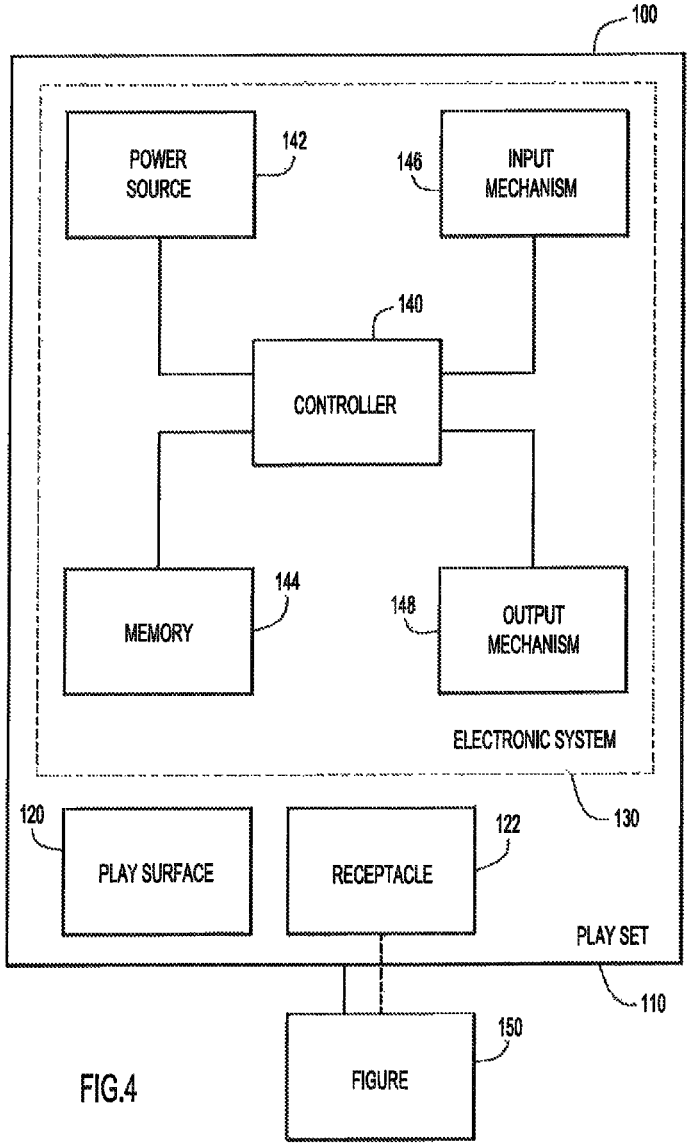
FIG. 4 illustrates a schematic block diagram of a play set or play surface in accordance with an embodiment of the present invention.

Referring to FIG. 4, an alternative embodiment of a toy assembly according to the present invention is illustrated. In this embodiment, the toy assembly 100 includes a play set 110 that has one or more play surfaces 120 and a receptacle or basin 122. As described above, a toy figure 150 can be coupled to the play set 110 and engageable with the contents in the receptacle 122. In addition, the play set 110 includes an electronic system 130 with a controller 140, a power source 142, a memory 144, an input mechanism 146 such as a microphone, and an output mechanism 148. In various embodiments of the invention, the output mechanism 148 is configured to generate a visual output (such as lights), an audible output (such as speech, sound effects, and/or music), and/or a combination of a visual output and an audible output. The output mechanism 148 can be a light emitting device, such as a light emitting diode, or a speaker or transducer.

Alternative means to describe the present invention include the following descriptions.

A toy figure comprising a skeleton having at least two bones; a resilient member loosely tethering the at least two bones; and a viscous fluid, wherein, the viscous fluid tackily adheres to the skeleton.

The toy figure described above, further comprising a skull and jawbone loosely tethered to the skeleton.

The toy figure and skull described above, wherein the skull comprises an articulating jawbone operable by a mechanical trigger configured on the skull.

The toy figure described above, further comprising a sound effect for playing a sound, a sound effect for recording a sound, a visual effect, and/or a stand for retaining a second figure.

Alternatively, a toy play set comprising a toy figure comprising a skeleton having at least two bones and a resilient member loosely tethering the at least two bones; a play surface comprising a basin configured to at least partially receive the toy figure; and a viscous fluid situated in the basin, wherein, the viscous fluid tackily adheres to the toy figure.

The toy play set described above, further comprising a skull and jawbone loosely tethered to the skeleton.

The toy play set described above, wherein the skull comprises an articulating jawbone operable by a mechanical trigger configured on the skull.

The toy play set described above, further comprising a sound effect for playing a sound, a sound effect for recording a sound, and/or a visual effect.

The toy play set described above, wherein the resilient member is tethered to the play surface.

The toy play set described above, further comprising a projectile launcher.

The toy play set described above, further comprising a stand for retaining a second figure. In one embodiment, the second figure further comprises a projectile launcher.

It is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any description recites "a" or "a first" element or the equivalent thereof, such disclosure should be understood to include incorporation of one or more such elements, neither requiring nor excluding two or more such elements.

While the invention has been described in detail and with references to specific embodiments thereof, it will be apparent to one skilled in the art that various changes and modifications can be made therein without departing from the spirit and scope of the invention. Thus, it is intended that the present invention covers the modifications and variations of this invention provided they come within the scope of the appended claims and their equivalents. For example, the majority of the elements can be formed of molded plastic. However, in alternative embodiments, the elements can be formed of a material other than plastic provided that the material has sufficient strength for the component's intended function.

What is claimed is:

1. A toy assembly, comprising:

a skeleton body having a first structural member and a second structural member;

a resilient member coupling the structural members to each other;

a base having a surface defining a receptacle, the receptacle being configured to receive a portion of the skeleton; and a viscous fluid disposed within the receptacle, the viscous fluid adhering to the structural members of the skeleton when the structural members are inserted into the receptacle.

2. The toy assembly of claim 1, further comprising:

a skull coupled to the skeleton body.

3. The toy assembly of claim 2, wherein the skull includes an articulating jaw member and an actuator coupled to the jaw member, the actuator being operable to move the jaw member relative to the skull.

4. The toy assembly of claim 1, wherein the structural members resemble bones of the skeleton body.

5. A toy assembly, comprising:

a toy figure including a skeleton body having a first structural member, a second structural member, and a flexible elongate member coupling the structural members together; and a base including a play surface defining a receptacle, the receptacle being configured to receive a portion of the toy figure, the receptacle containing a viscous fluid disposed therein, the viscous fluid being adhered to the toy figure when the portion of the toy figure engages the fluid.

6. The toy assembly of claim 5, further comprising:

a skull coupled to the skeleton body.

7. The toy assembly of claim 6, wherein the skull includes an articulating jaw member and an actuator coupled to the jaw member, the actuator being operable to move the jaw member relative to the skull.

8. The toy assembly of claim 5, wherein the structural members resemble bones of the skeleton body.

9. The toy assembly of claim 5, wherein the elongate member is coupled to the base.

10. The toy assembly of claim 5, further comprising:

a projectile launcher.

11. The toy assembly of claim 5, further comprising:

a second figure; and a stand coupled to the base, the stand configured to support the second figure relative to the base.

12. The toy assembly of claim 11, wherein the second figure includes a projectile launcher.

13. A toy assembly, comprising:

a toy figure including:

a body portion having a first structural member resembling a bone and a second structural member resembling a bone; and an elongate member coupling the structural members together, the elongate member being flexible; and a play set including:

a base having a surface defining a receptacle, the receptacle being configured to receive a portion of the toy figure; and a viscous fluid disposed in the receptacle, wherein the viscous fluid tackily adheres to the toy figure when the toy figure is engaged with the viscous fluid.

14. The toy assembly of claim 13, further comprising:

a skull coupled to the body portion.

15. The toy assembly of claim 14, wherein the skull includes an articulating jaw member and an actuator coupled to the jaw member, the actuator being operable to move the jaw member relative to the skull.

16. The toy assembly of claim 14, wherein the toy figure includes a handle portion coupled to the skull, the handle portion being configured to be grasped by a user.

17. The toy assembly of claim 16, wherein the handle portion is useable to move at least one of the structural members into engagement with the viscous fluid.

18. The toy assembly of claim 13, wherein the receptacle is configured to receive at least one of the structural members.

19. The toy assembly of claim 13, wherein each of the structural members has a hole defined therein, and the elongate member extends through a hole of each structural member.

20. The toy assembly of claim 13, wherein the elongate member is coupled to the base.

* * * * *

UNITED STATES PATENT AND TRADEMARK OFFICE

CERTIFICATE OF CORRECTION

PATENT NO. : 8,864,548 B2
APPLICATION NO. : 13/421694
DATED : October 21, 2014
INVENTOR(S) : Viet Nguyen and Michael O'Hare It is certified that error appears in the above-identified patent and that said Letters Patent is hereby corrected as shown below:

In the Specification

Column 2, Line 67, change "FIG." to --figure--
Column 3, Line 2, change "FIG." to --figure--
Column 3, Line 22, change "FIG." to --figure--
Column 3, Line 23, for each of the two (2) instances, change "FIG." to --figure--
Column 3, Line 25, change "FIG." to --figure--
Column 3, Line 30, change "FIG." to --figure--
Column 4, Line 21, change "FIG." to --figure--
Column 4, Line 25, change "FIG." to --figure--
Column 4, Line 26, change "FIG." to --figure--
Column 4, Line 28, change "FIG." to --figure--
Column 4, Line 30, change "FIG." to --figure--
Column 4, Line 32, change "FIG." to --figure--
Column 4, Line 34, change "FIG." to --figure--
Column 4, Line 36, change "FIG." to --figure--
Column 4, Line 38, change "FIG." to --figure--
Column 4, Line 39, for each of the two (2) instances, change "FIG." to --figure--
Column 4, Line 42, change "FIG." to --figure--
Column 4, Line 44, change "FIG." to --figure--
Column 4, Line 49, change "FIG." to --figure--
Column 4, Line 50, change "FIG." to --figure--
Column 4, Line 55, change "FIG." to --figure--
Column 4, Line 56, change "FIG." to --figure--
Column 4, Line 57, change "FIG." to --figure--
Column 4, Line 63, change "FIG." to --figure--
Column 4, Line 64, change "FIG." to --figure--

Signed and Sealed this
Twelfth Day of May, 2015

Michelle K. Lee

Michelle K. Lee
*Director of the United States Patent and Trademark Office*